United States Patent [19]

Rodseth

[11] 4,130,913

[45] Dec. 26, 1978

[54] DOOR CLOSER

[75] Inventor: William G. Rodseth, Princeton, Ill.

[73] Assignee: Schlage Lock Company, San Francisco, Calif.

[21] Appl. No.: 825,591

[22] Filed: Aug. 18, 1977

[51] Int. Cl.[2] ..... E05F 3/00

[52] U.S. Cl. ..... 16/49

[58] Field of Search ..... 16/49, 51, 56, 58, 59, 16/62, 79, 69, 64, 82, 84, DIG. 9, DIG. 10

[56] References Cited

U.S. PATENT DOCUMENTS

| | | | |
|---|---|---|---|
| 1,840,558 | 1/1932 | Bernhard | 16/51 |

FOREIGN PATENT DOCUMENTS

| | | | |
|---|---|---|---|
| 516391 | 2/1955 | Italy | 16/51 |
| 87516 | 9/1934 | Sweden | 16/58 |
| 860070 | 5/1957 | United Kingdom | 16/51 |

*Primary Examiner*—Ronald Feldbaum

*Attorney, Agent, or Firm*—Lothrop & West

[57] ABSTRACT

A door closer used with a door frame and a door panel has a hold-open device for holding the closer in any full or intermediate door-open position. The door panel is free for some manual operation independently of the closer because of a lost-motion, rotary connection between the door frame and door panel. This involves a closer shaft having a thread therein or thereon engaged by a threaded member on the closer arm so that when the member and shaft rotate relative to each other, there is also relative axial translation between them. When the hold-open device is released from some set open position after some manual, door panel closing motion, the shaft revolves, causing some originally abutting but separated facing surfaces on the member and the shaft axially to approach each other and finally and again to abut, thus taking out the lost motion and causing the closer to move the door panel from substantially fully open or any intermediate open position into fully closed position.

16 Claims, 4 Drawing Figures

DOOR CLOSER

BRIEF SUMMARY OF THE INVENTION

It is customary to provide a door panel hinged to a door frame with a door closer having a spring for urging the door closed. Under some circumstances it is desired to have the door panel remain open despite the spring urgency. For that reason, a closer is often augmented with a device for blocking or holding the closer mechanism with the door in a fully-open or intermediately-open position. While this is satisfactory under many circumstances, it does not meet all of the requirements since sometimes, particularly in emergencies, the door must be closed. There is then provided a mechanism for releasing the hold-open so the closer spring can propel the door panel to its closed position. Sometimes there is a desire not only to have the hold-open automatically released in an emergency, but additionally under usual conditions to have the door panel free for manual motion. This involves a disconnection between the panel and the closer mechanism. Yet, in the event of emergency, the closer must move the door panel from whatever fully-open or intermediately-open position it may occupy into fully closed position. That aim is achieved by providing on the customary shaft of the door closer a thread interengaged with a corresponding thread in or on a member on the closer arm, the shaft and member being part of the interconnection between the door frame and door panel. The interthreaded member and shaft are especially provided with axially abutting surfaces so positioned that the surfaces are in abutment when the door panel is being opened and touch each other in any intermediate opening or fully open position. After the hold-open is or has been set, stopped or held in any intermediate or fully open position, the door panel can then be manually moved toward or into closed position without disturbing the hold-open setting. This is because the threads rotate relative to each other and move the axially facing surfaces axially to provide lost motion. This lost motion is taken up whenever the hold-open is released, for then the closer spring moves the member back along the shaft until the axially facing surfaces abut. The closer spring then propels the door panel to closed position.

DETAILED DESCRIPTION

Figure 1:
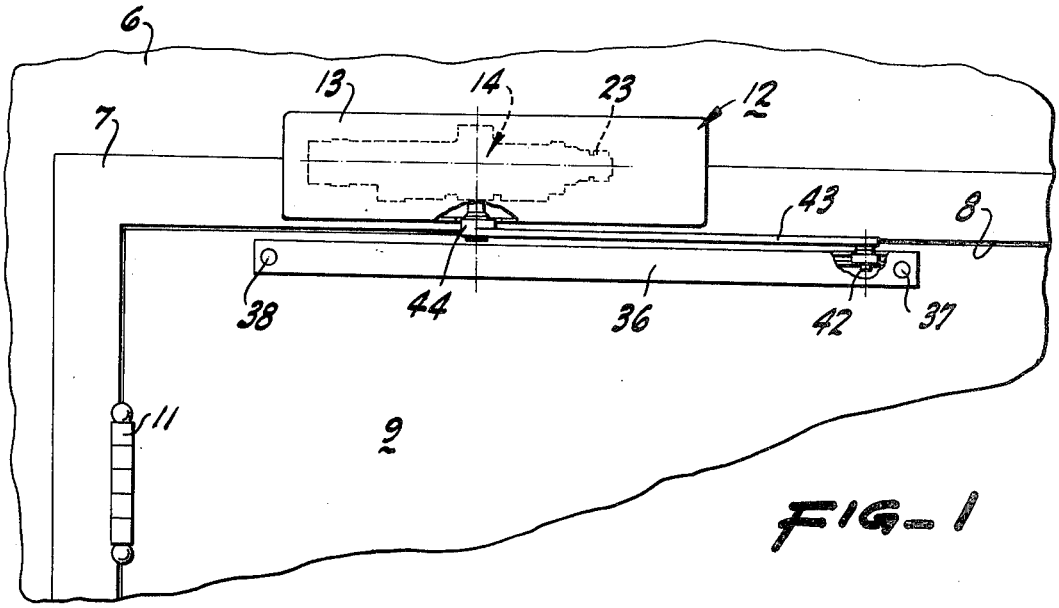
FIG. 1 is an elevation, with portions broken away, of a door closer pursuant to the invention located on and interconnecting a door frame and a door panel.

The door closer of the invention can be incorporated in a number of different ways and in a number of different environments, being especially adapted to each if necessary. In the present typical instance the device is utilized in connection with a wall 6 having a door frame 7 therein surrounding a door opening 8 within which a door panel 9 is disposed for swinging operation about a vertical axis determined by a hinge structure 11. The door panel 9 is free to swing between a closed position, as shown by solid lines in FIGS. 1 and 2, and a fully open position, indicated by broken lines in FIG. 2, and is also able to occupy any intermediate position, as represented by lighter broken lines in FIG. 2.

Movement of the door panel relative to the frame is constrained by a door closer mechanism generally designated 12. In some instances the spring and control mechanisms of the closer 12 are mounted on or recessed into the frame 7 with a movable connection to the door panel 9, and in other instances the spring and control of the closer mechanism are principally mounted on or recessed into the door panel with a movable connection to the frame 7. Since these installations are common, it is intended herein by referring to an interconnection between the door frame and the door panel through the closer mechanism to include these mounting arrangements.

As particularly shown in FIG. 1, the door closer 12 has an enclosing casing 13 removable to disclose the spring and control mechanism 14 secured to the door frame 7. This mechanism can be of any convenient kind and, as an example herein, includes a housing 16 (FIG. 3) fastened on the door frame and including an arrangement of the sort shown in the Norton U.S. Pat. No. 2,024,472, the Farris U.S. Pat. No. 3,934,306 and the Gaysowski U.S. Pat. No. 3,648,326. The present construction employs in the housing a closing spring 17, sometimes multiplied to include a supplemental spring 18, effective against one end 19 of a piston slidable within the housing. At its far end the piston has another piston end 21 in a chamber 22 designed to retain hydraulic fluid except for an excape passage. The escape passage is controlled by a valve moved by a solenoid 23 (FIG. 1) connected in an appropriate control circuit.

The piston ends 19 and 21 are unitary with a rack 24 designed to reciprocate longitudinally in the housing in engagement with a gear 26 on a shaft 27 mounted for rotation in the housing 16 by antifriction bearings 28 and 29. The shaft rotates relative to the housing about an axis 31 but is prevened from moving along the axis by the bearings 28 and 29. The shaft extends from the housing through a packing gland 32 to provide an extended external portion 33. Rotation of the shaft 27 and reciprocation of the rack 24 occur simultaneously and in proportion between extreme positions.

The shaft 27 and the cooperating element, the door panel 9 in this instance, may be interconnected in any one of several ways. Sometimes a pair of folded, relatively pivoted arms are used, and sometimes a roller and channel connector is employed. They are considered as equivalent. In this instance, as shown especially in FIGS. 1 and 2, the preferred interconnection includes a channel member 36 held to the panel 9 by fastenings 37 and 38. The channel has an upwardly open groove 39 within which a roller 41 is disposed for reciprocation. The roller is slightly spherical and is journalled on a pin 42 secure in one end of an arm 43. The outer end of the arm is enlarged to form a hub 44 concentric or coaxial with the shaft 27.

Particularly in accordance with the present invention, the shaft 27, and particularly the extended portion 33 thereof, is bored out along the axis and is provided with internal threads 46 or inclines or ramps. These are in engagement with corresponding external threads 47 or inclines or ramps on a bolt 48 having a boss 49 seated in the hub 44. Preferably the boss 49 is noncircular, so that it and the hub 44 are locked against rotation relative to each other but both can rotate in unison about the axis 31. A threaded cap 51 holds the lever and the boss in place in one axial direction. Additionally engaging the threaded member or bolt 48 is an optional keeper nut 52 threadedly engaging the member 48 and tightly jammed against the hub 44. The arm hub 44 and the boss 49 are pinched between such nut 52 and the keeper cap 51 and function as one unit.

With this arrangement, the shaft 27 with the internal threads 46 can be considered as the equivalent of an externally threaded shaft, and the bolt 48 can be considered as the equivalent of a nut or an internally threaded member. That is, the internal and external threads on the parts 27 and 48 can be interchanged without functional change. The illustrated arrangement is such that the threads 46 extend to the end of the shaft 27 and there merge with a flat surface 53 substantially normal to the axis 31. Facing the surface 53 is a similar flat surface 54 also substantially normal to the axis 31. The upper normal surface of the hub 44 can serve as well as the surface 54, should it be desired to omit the nut 52.

There is relative rotational and concurrent relative axial movement possible between the shaft 27 and the bolt 48. That is, the arm 43 can rotate relative to the shaft 27 about the axis 31, and such relative motion is accompanied by axial displacement of the arm and the shaft with respect to each other. The axial displacement affords space between the surfaces 53 and 54. The axial movement can be referred to as lost motion and is indefinite in extent except as limited in one direction by close abutment of the surfaces 53 and 54. After such abutment, the shaft 27 and the lever 43 must rotate in unison in one direction, but can separate easily upon relative movement in the other direction for an increase in the lost-motion space between the surfaces 53 and 54.

Figure 2:
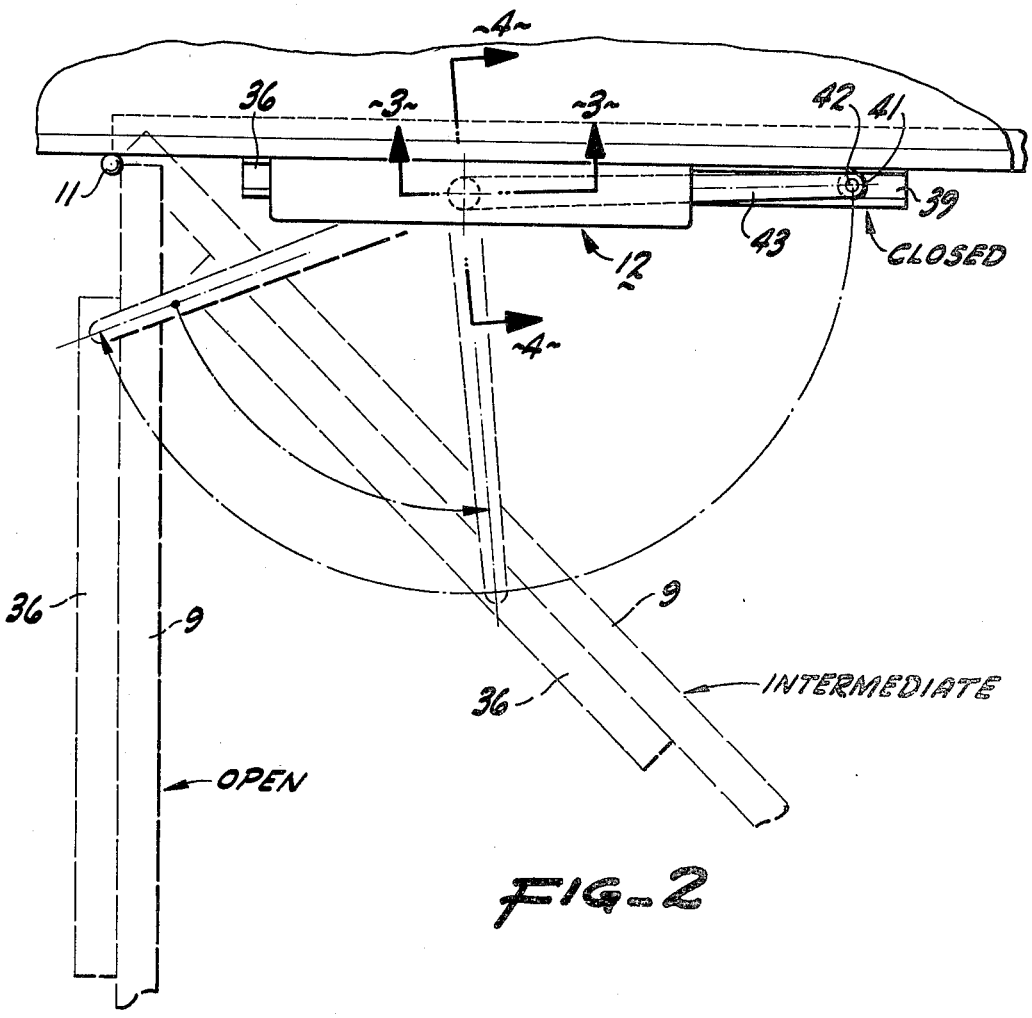
FIG. 2 is a plan of the structure shown in FIG. 1, the door panel being shown both in closed, intermediate and fully open positions.

As an example, it may be assumed that the door panel 9 is in its fully open position as shown in FIG. 2. In this location the roller 41 is near the hinge end of the channel 36. The surfaces 53 and 54 are in abutment, and the gear 26 and the rack 24 are positioned so that the springs 17 and 18 are fully compressed. The chamber 22 is full of hydraulic fluid, which is prevented from escaping since the closer is in its "hold-open" position and the solenoid 23 is energized. The parts of the spring and control mechanism 14 occupy and are held indefinitely in their fully open or hold-open position.

The door panel 9, despite the hold-open, can be swung by hand from its fully open position into and out of any intermediate or even closed position, as shown in FIG. 2. This manual panel motion causes a corresponding swinging movement of the arm 43, but such motion is not transmitted to the restrained shaft 27. The threads between the member 48 and the member 27 simply rotate relative to each other, accompanied by greater or less axial separation of the surfaces 53 and 54. In many installations, the hold-open can be set or locked in any intermediate open position. In this case the panel can still be freely swung manually between that intermediate hold-open position and closed. When the door panel leaves the closer hold-open position, the space between the surfaces 53 and 54 increases, and when the door panel approaches the chosen hold-open position (whether or not fully open position) the surfaces 53 and 54 approach each other. When the panel gets into the hold-open position, the surfaces 53 and 54 are in abutment.

Figure 3:
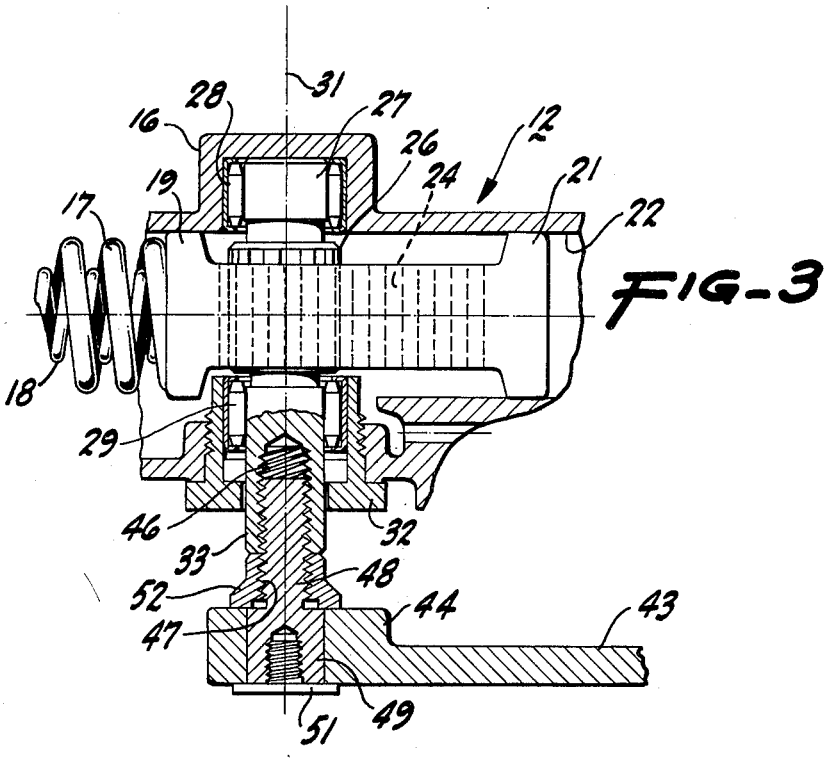
FIG. 3 is a detail of the closer mechanism, portions being broken away, shown principally in cross-section on a plane indicated by the line 3—3 of FIG. 2.
Figure 4:
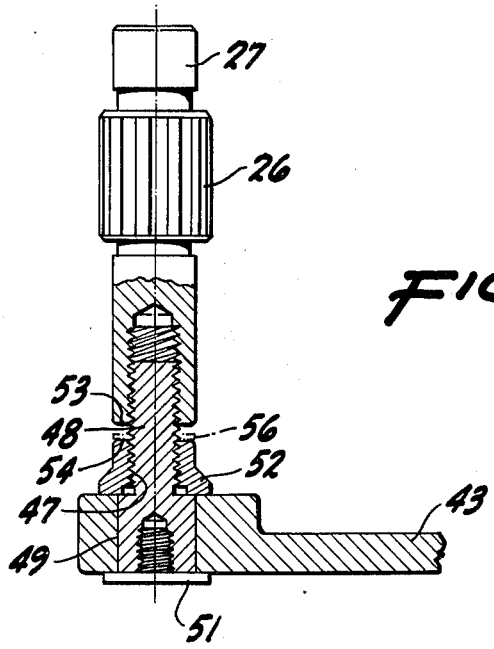
FIG. 4 is a view comparable to FIG. 3, portions being omitted, but in cross-section taken on the line 4—4 of FIG. 2 at substantially a right angle to the view in FIG. 3.

Should the door panel be left in any intermediate position between full open and full closed when the hold-open restraint on the closer springs 17 and 18 is relaxed; that is, when the solenoid 23 is deenergized to release liquid from the chamber 22, then the springs 17 and 18 displace the rack 24 toward the right in FIG. 3. This rotates the gear 26 and the shaft 27 in a direction to swing the arm 43 toward closing position or counterclockwise, as seen in FIG. 2. If at that time the door panel is in fully open position, the surfaces 53 and 54 are in firm axial abutment, and the arm 43 moves the door panel closed mandatorily into fully closed position. Should the door panel be in any intermediate position when the closer hold-open is released, then the arm hub 44 is axially spaced from the shaft end and the surfaces 53 and 54 are axially separated. Upon release of the closer mechanism the shaft 27 rotates and through the threaded connection takes up by rotation and by axial movement any space or lost motion between the surfaces 53 and 54 in any position of the panel, then picks up the arm 43 and moves the door panel positively into its fully closed position.

There is some axial displacement of the hub 44 with this mechanism, but there is in practice enough tilting or rising and falling available in the connection between the roller 41 and the channel 36 to accomodate the slight hub motion. Furthermore, the threads may be slightly loose and the roller 41 may be sufficiently spherical so that the parts may without harm occupy an angular position not in a plane normal to the axis 31.

It is important that the surfaces 53 and 54 abut tightly but are not wedged together and, by the same token, that the threads 46 and 47 are not wedged together. That can be accomplished by using a relatively steep, nonwedging pitch for the threads. It can also be accomplished by reducing the interthread friction as much as possible; for example, by utilizing very low friction materials for these parts. It is also helpful to make the surfaces 53 and 54 of nonadhesive or noncohesive materials and having a very low coefficient of friction. If the materials themselves are not of low friction, a thin washer 56 of low friction material can be placed between the surfaces 53 and 54.

There has been provided a door closer mechanism which has the customary closing feature, a hold-open feature with automatic remote release, and the feature of permitting manual swinging of the door panel to any position without at any time interfering with the effective operation of the door closer mechanism in the event of an emergency when the solenoid releases the restraint. The present structure can readily be adapted to closers of a standard construction and occupies very little or no extra space, being effectively incorporated within the dimensions of presently available door closer mechanisms.

I claim:

1. A door closer for use with a door frame and a door panel comprising a housing, a shaft having a thread, means mounting said shaft to rotate about an axis in said housing, means constraining said shaft against axial movement relative to said housing, means interconnecting said door frame and said door panel through said housing and said shaft, said interconnecting means including a member engaging said thread and movable axially of said shaft, and means on said shaft and on said member for limiting axial movement of said member and said shaft.

2. A device as in claim 1 including means in said housing for restricting rotation of said shaft in said housing.

3. A device as in claim 1 in which said limiting means includes a surface on said member and a surface on said shaft adapted to abut in a plane substantially normal to said axis.

4. A device as in claim 3 in which the angle of said thread precludes wedging said surfaces together.

5. A device as in claim 3 in which said surfaces abut when said panel and said frame are substantially in a predetermined position of said door panel relative to said door frame.

6. A device as in claim 3 in which said surfaces are axially spaced apart when said panel and said frame are in any position relative to each other and away from a predetermined open position relative to each other.

7. A device as in claim 3 including means for reducing friction between said surfaces.

8. In a door closer, a housing, a shaft, means for mounting said shaft to rotate about an axis in said housing, an actuating arm, and means for mounting said actuating arm on said shaft for combined rotary and axial motion relative thereto.

9. A device as in claim 8 including means for limiting said combined rotary and axial motion in one relative axial position of said arm and said shaft.

10. A device as in claim 9 including means for changing said axial position.

11. In a door closer having a housing, a shaft having an axis, means for constraining said shaft to rotation in said housing about said axis and against translation along said axis, a closer arm, and means for mounting said closer arm on said shaft for rotation relative to said shaft about said axis and for movement axially of said shaft.

12. A device as in claim 11 in which said rotation and said movememt axailly are concurrent.

13. A device as in claim 11 in which said mounting means includes a first incline on said shaft helical about said axis, and a second incline on said arm helical about said axis and engaging said first incline.

14. A device as in claim 13 in which said inclines are threads.

15. A device as in claim 13 including means on said shaft and on said arm defining surfaces substantially normal to said axis and movable toward and away from abutment with each other upon relative rotation of said arm and said shaft.

16. A device as in claim 13 in which said inclines are pitched to urge said surfaces toward abutment when said door panel is moved toward open position relative to said frame.

* * * * *